US005620222A

United States Patent [19]

Prinz

[11] Patent Number: 5,620,222

[45] Date of Patent: Apr. 15, 1997

[54] ELECTRO-HYDRAULIC RECTANGULAR GRAPPLE FOR RAILCARS

[75] Inventor: Peter F. Prinz, Ethel, La.

[73] Assignee: Hawco Manufacturing Co., Inc., Slaughter, La.

[21] Appl. No.: 388,387

[22] Filed: Feb. 14, 1995

[51] Int. Cl.[6] ..... B66C 3/16

[52] U.S. Cl. ..... 294/88; 294/106

[58] Field of Search ..... 294/68.3, 68.23, 294/81.51, 81.61, 87.1, 88, 106, 107; 37/182; 111/101

[56] References Cited

U.S. PATENT DOCUMENTS

| | | | |
|---|---|---|---|
| 2,652,280 | 9/1953 | Billings | 294/88 |
| 3,439,818 | 4/1969 | O'Neil | 294/106 |
| 3,589,766 | 6/1971 | Bormioli | 294/88 |
| 3,799,602 | 3/1974 | Laws et al. | 294/106 |
| 3,877,743 | 4/1975 | Johnson | 294/88 |
| 3,881,620 | 5/1975 | Walker | 214/620 |
| 3,987,905 | 10/1976 | Dechantsreiter | 294/81.61 |
| 4,023,848 | 5/1977 | Bennett | 294/88 |
| 4,057,278 | 11/1977 | Götzen | 294/88 |
| 4,502,723 | 3/1985 | Kuromoto | 294/88 |
| 4,525,121 | 6/1985 | Cawley | 294/107 |
| 5,330,242 | 7/1994 | Lucky, Sr. | 294/88 |

FOREIGN PATENT DOCUMENTS

| | | | |
|---|---|---|---|
| 3502552 | 9/1985 | Germany | 294/68.23 |
| 9214226.5 | 2/1993 | Germany . . | |
| 1184790 | 10/1985 | U.S.S.R. | 294/81.51 |

OTHER PUBLICATIONS

6–Tine Scrap Grapple Electro–Hydraulic Design, Preliminary Proposal drawing Apr. 12, 1993.

*Primary Examiner*—Dean Kramer
*Attorney, Agent, or Firm*—Roy, Kiesel & Tucker

[57] ABSTRACT

The present invention provides a novel grapple type of device for removing bulky materials from containers such as rail cars. The invention conforms to the general shape of rail cars and is able to enclose the bulky material from all sides. Therefore a grapple is provided comprising a housing which has a side and an end, with the end being shorter in length than the side. The grapple also has an attachment device positioned on the housing for attaching a tension member to the housing. A plurality of tines are pivotally attached to the housing along the side and at least one fine is pivotally attached to the housing along the end. There are further a plurality of fine actuating devices, each of the actuating devices having a first end attached to the housing and a second end attached to one of the tines. Additionally, the grapple contains a fluid supply mechanism operatively attached to the tine actuating devices, the fluid supply mechanism being positioned on the grapple.

10 Claims, 5 Drawing Sheets

ELECTRO-HYDRAULIC RECTANGULAR GRAPPLE FOR RAILCARS

BACKGROUND OF INVENTION

1. Field of Invention

This invention relates to grapples designed to pick up bulky materials. More specifically, this invention relates to hydraulically operated grapples designed to pick up bulky materials from containers or platforms such as rail cars or tracks.

2. Description of Prior Art

Hydraulically operated grapples are own in the art. See U.S. Pat. No. 3,877,743 to Johnson. Grapples such as that disclosed in the Johnson patent generally employ hydraulic cylinders to open and close the tines of the grapple. As in Johnson, these grapples utilized a hydraulic fluid pressurizing mechanism, such a pump, that is remote from the grapple. The pressurized hydraulic fluid is transferred from the hydraulic pump to the grapple through a system of hoses. This design has several disadvantages. First, the length of hose itself is a disadvantage. The entire length of hose, often arranged around moving parts, is subject to damage or puncture. Secondly, this hydraulic arrangement requires the machinery operating the grapple to be equipped with a suitable hydraulic pump and connections. A grapple deuce hang an internal hydraulic pumping mechanism would allow a wider variety of machines to utilize the grapple. Additionally, such an internal pump would allow hydraulic hoses to be much shorter and eliminate the necessity of running the hoses along many moving parts of the grapple and the machine operating the grapple.

Another disadvantage arises when grapples are unloading containers with side walls. Many grapples have the tines oriented in a circular configuration. See U.S. Pat. No. 5,330,242 to Lucky. This configuration does have the advantage that the bulky material being picked up, such as scrap metal, is enclosed from all sides, which tends to lessen the amount of scrap that escapes between the tines as they are being closed. However, when the scrap is to be removed from a container having side walls, such as a rail car or many truck beds, the circular configuration often presents a problem. The circular grapples may be too large for the tines to fit between the side walls of the container. If the circular grapple is small enough to fit between the side walls of the container, the smaller size prohibitively reduces the rate at which materials can be transferred.

A possible solution to this difficulty is the design of grapples which are more or less rectangular to conform to the shape of the container vehicle. Such a grapple could be designed to have multiple tines positioned on the longer parallel sides of the grapple. While this design allows a larger grapple to be lowered between the side walls of the container, it also has certain disadvantages over the circular grapples. The above described rectangular grapple does not enclose the scrap from all sides as does the circular grapple, allowing significant amounts of scrap to escape from the unenclosed ends. This results in a substantial decrease in the efficiency of the grapple's operation. What is needed in the art is a grapple which can fit between the side walls of a container, but still enclose the scrap from all sides.

SUMMARY OF INVENTION

It is therefore an object of this invention to provide a grapple that has an internal fluid supply mechanism.

It is further an object of this invention to provide a grapple with a configuration that allows it to operate between the side walls of a container, yet still allows the grapple to enclose the bulky material from all sides.

Therefore a grapple is provided comprising a housing which has a side and an end, with the end being shorter in length than the side. The grapple also has an attachment device positioned on the housing for attaching a tension member to the housing. A plurality of fines are pivotally attached to the housing along the side and at least one line is pivotally attached to the housing along the end. There are further a plurality of tine actuating devices, each of the actuating devices having a first end attached to the housing and a second end attached to one of the tines. Additionally, the grapple contains a fluid supply mechanism operatively attached to the tine actuating devices, the fluid supply mechanism being positioned on the grapple.

DETAILED DESCRIPTION

Figure 1:
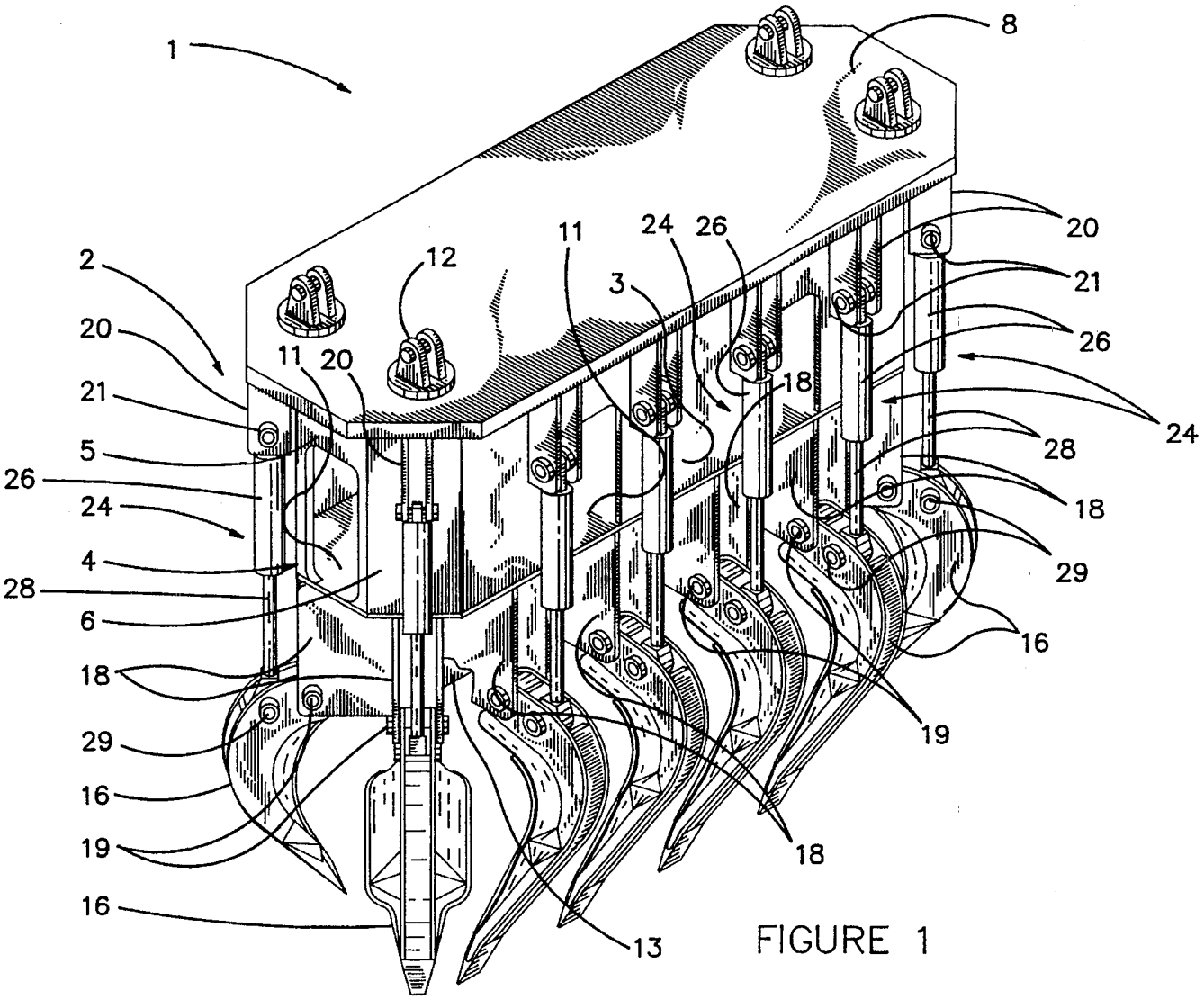
FIG. 1 is a perspective view of the rail car grapple
Figure 3:
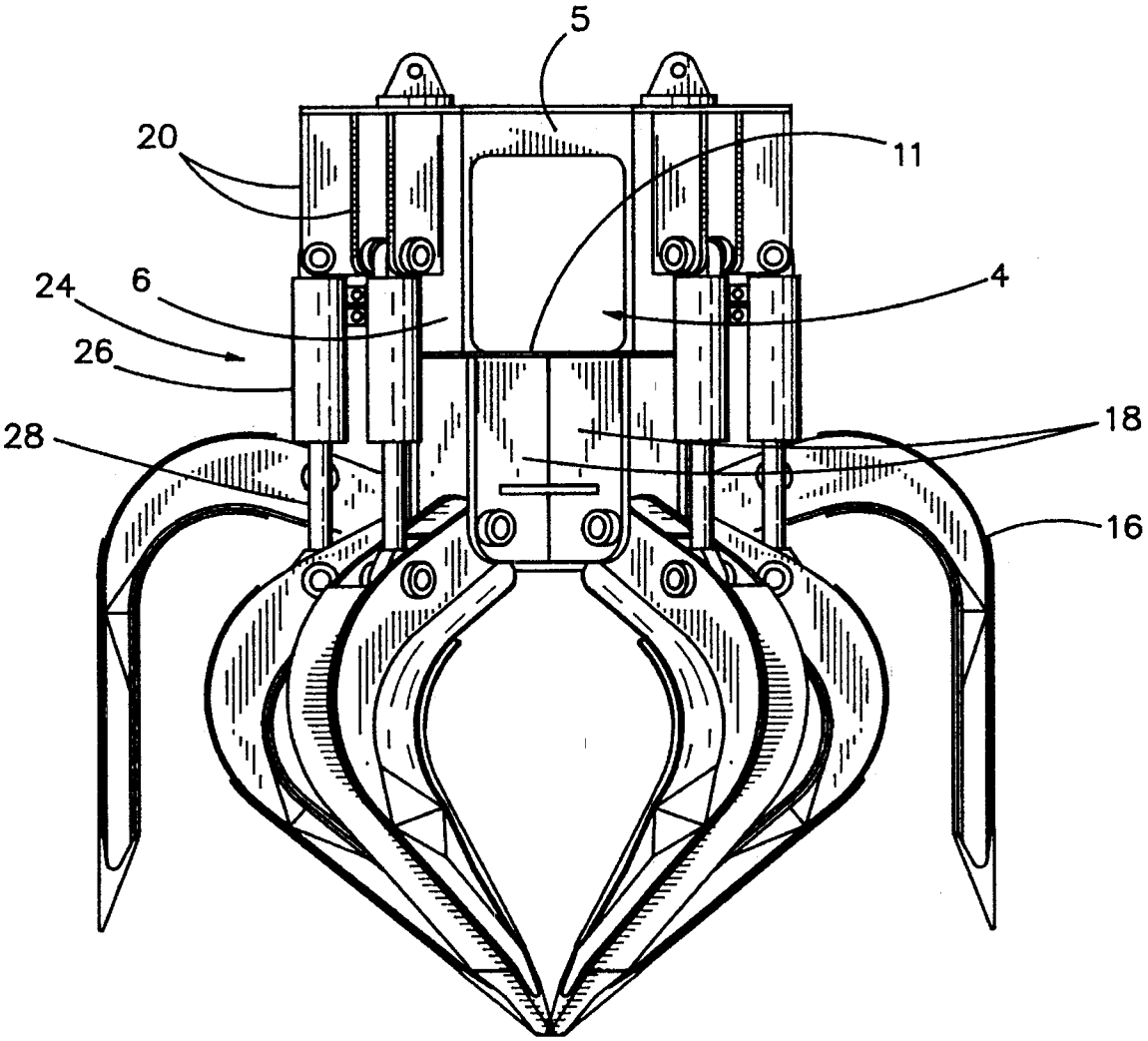
FIG. 3 is an end view of the rail ear grapple.

One preferred embodiment of the present invention is depicted in FIG. 1. The rail car grapple 1 comprises a housing 2 which is formed by the connecting together of several plate segments. In one preferred embodiment, the connection is accomplished by welding, but it will be understood that any conventional means of connecting metal can be used in connecting the metal structures disclosed herein. In the embodiment shown in FIG. 1, the side plate 3 is the longest segment of the housing 2. While not seen in FIG. 1, an identical side plate 3 is positioned on the opposite side of the housing 2. The housing 2 also comprises end plates 4, which include three segments; middle segment 5 and two oblique segments 6. FIG. 1 best shows the relative orientation of oblique segments 6 to middle segment 5, while FIG. 3 more clearly illustrates the positioning of an oblique segment 6 on either side of middle segment 5.

Figure 4:
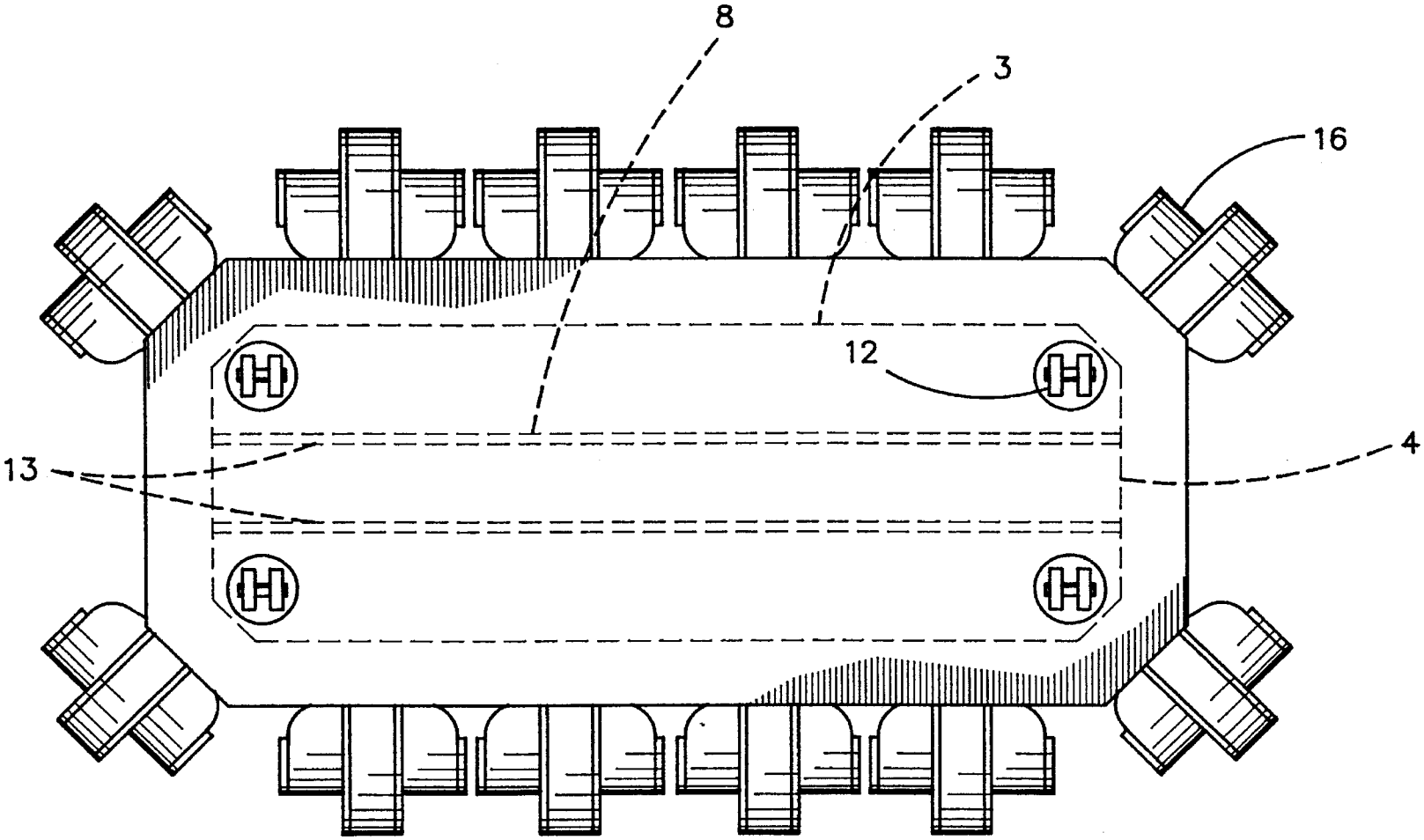
FIG. 4 is a top view of the rail ear grapple.

The housing 2 further has top plate 8. As seen in FIG. 1, top plate 8 extends somewhat past side plates 3 and end plates 4. This allows for a more secure connection of cylinder brackets 20, as will be explained more fully below. While top plate 8 is generally rectangular, the outer edge parallels the perimeter (shown in FIG. 4 as a dashed line) formed by the side plates 3 and end plates 4. Positioned generally in the corners of top plate 8 are lifting brackets 12. Cables, chains or other tension bearing members will be pinned to lifting brackets 12 allowing the rail car grapple 1 to be lifted and moved during operation. The underside of housing 2 has a bottom plate 11, part of which can be seen through the weight saving apertures formed in side plates 3 and end plates 4, as shown in FIG. 1. Bottom plate 11 is parallel to top plate 8, but bottom plate 11 does not extend beyond the perimeter of side plates 3 and end plates 4 as top plate 8 does.

Figure 2:
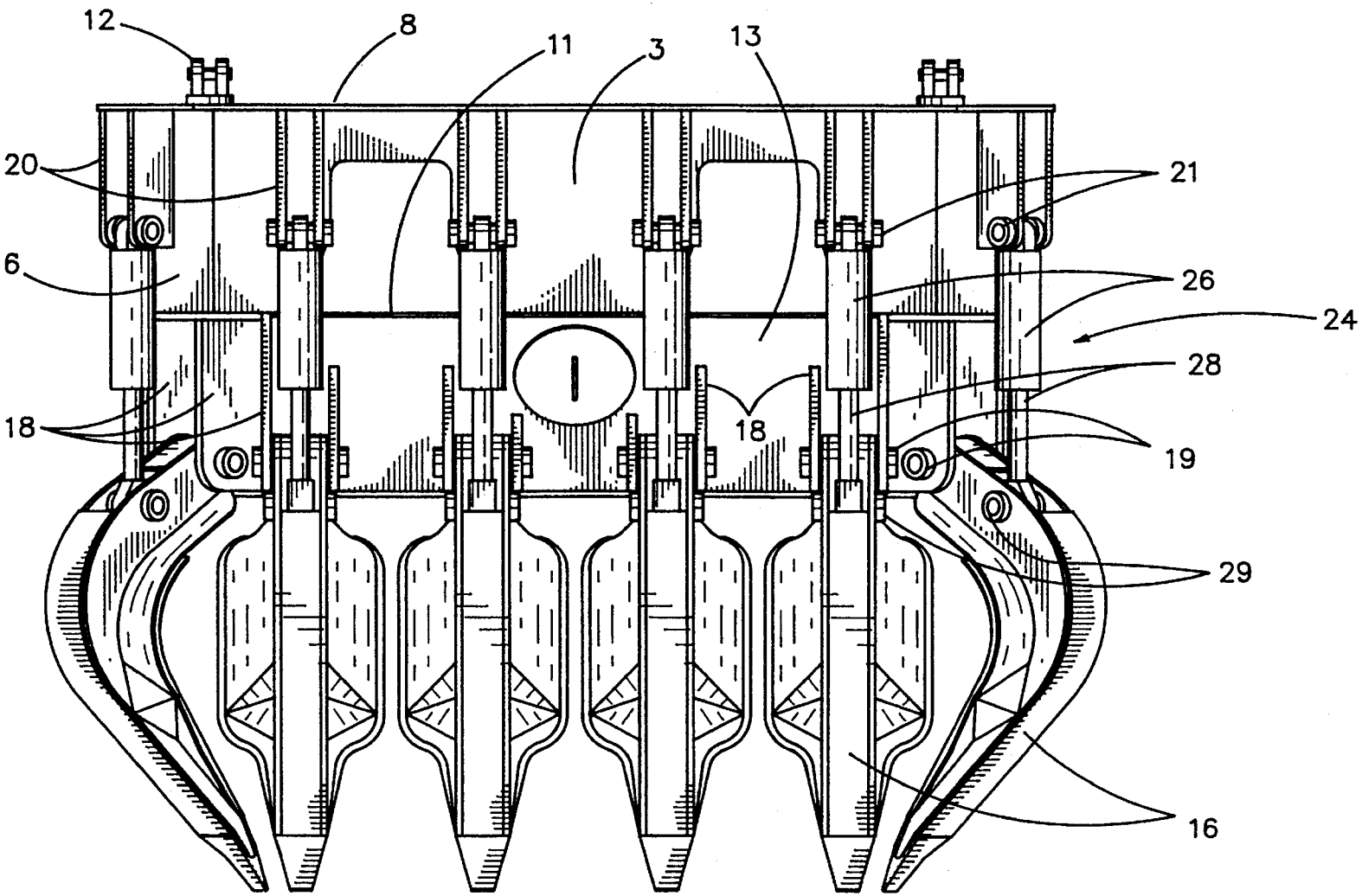
FIG. 2 is a side view of the rail car grapple.

Positioned along the perimeter of housing 2 are a plurality of tines 16. While the number of tines 16 may be varied, the embodiment depicted in the figures has a total of twelve tines 16. As best seen in FIG. 2, central plates 13 are positioned underneath housing 2 and run substantially the length of housing 2. While only one central plate 13 is shown in FIG. 2, the depicted embodiment has two central plates 13, the positioning of which is as shown by dashed lines in FIG. 4. As FIG. S 1 and 2 illustrate, attached to the central plates 13 are four tine brackets 18 running along the side of housing 2. In FIG. 1, a portion of one line bracket 18 has been cut away to show the relative positions of central plate 13 and tine brackets 18. The tine brackets 18 extend perpendicularly from central plates 13 and tines 16 are in turn pivotally attached to tine brackets 18 by way of tine pins 19.

The two tines 16 located at each end of housing 2 are positioned somewhat differently than the tines 16 running along the sides of housing 2. As best seen in FIG. 1, the two tine brackets 18 at each end of housing 2 are attached to the bottom plate 11 under oblique segments 6 of end plates 4 and extend in the same direction as oblique segments 6. This orientation of the tines 16 in the same direction as oblique segments 6 allows these tines 16 to operate without interfering with the other tine 16 on that end of housing 2 or the adjacent tine 16 on the central plate 13. As those skilled in the art will understand, the positioning of two tines 16 on the end of housing 2 has the considerable advantage of allowing the rail car grapple 1 to more completely enclose the material being picked up.

Also positioned along the sides and ends of housing 2, each tine 16 has an actuating device for opening and closing the tine 16. In the embodiment shown, the actuating device is a hydraulic cylinder and ram assembly 24, which comprises cylinder 26 and ram 28. The cylinders 26 are fixed to the side plates 3 and end plates 4 by the cylinder brackets 20 and cylinder pins 21. As can be seen in FIG. 1, the cylinder brackets 20 positioned on end plates 4 are attached to the oblique segments 6 of end plates 4. The cylinder brackets 20 are positioned above and generally in alignment with tine brackets 18. In the embodiment shown, the cylinder brackets 20 are attached not only the side plates 3 or end plates 4, but the upper ends of brackets 20 are also attached to the overhanging portion of top plate 8. To provide the mechanical connection between the tines 16 and cylinder and ram assemblies 24, each ram 28 of the hydraulic assemblies 24 is pivotally attached to a tine 16 by way of ram pin 29.

Figure 5:
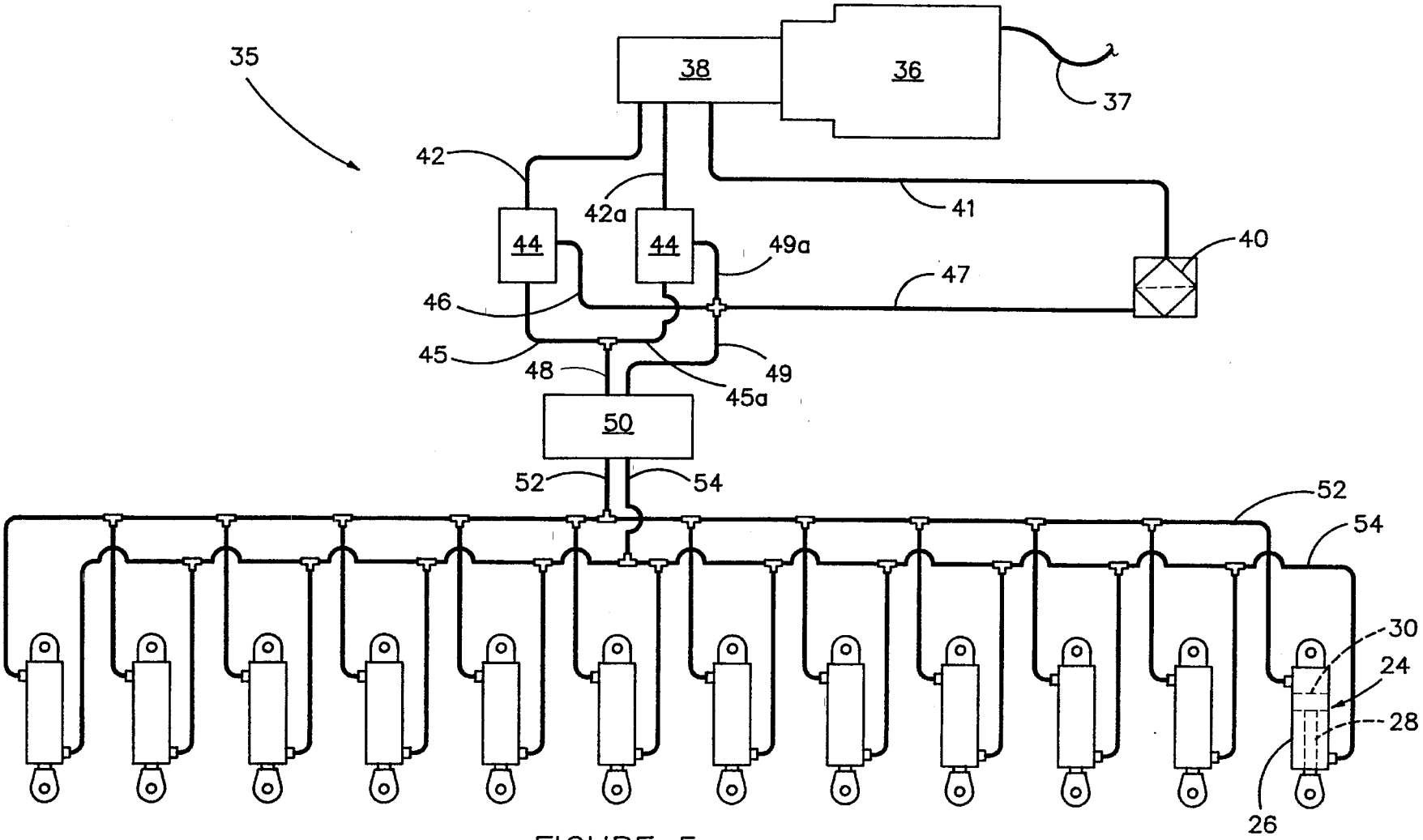
FIG. 5 is a schematic figure of the hydraulic fluid supply mechanism.

In order to extend and retract ram 28 and thereby open and close tines 16, the rail car grapple 1 is provided with a fluid supply mechanism 35 that is operatively attached to the hydraulic cylinder and ram assemblies 24 and is positioned in housing 1. In the embodiment depicted by schematic FIG. 5, the fluid supply mechanism 35 comprises, in part, an electric motor 36 powered by electric cable 37, which will run to a power source located on the crane or other machine operating the grapple 1. The fluid supply mechanism 35 further comprises a hydraulic pump 38, fluid reservoir 40, unloading valves 44, a directional control valve 50 and numerous fluid carrying lines interconnecting these elements.

Electric motor 36 is operatively connected to hydraulic pump 38. Hydraulic pump 38 draws hydraulic fluid from fluid reservoir 40 via line 41 and pumps the fluid into unloading valves 44 by way of lines 42 and **42*a*. Unloading valves 44 may be calibrated to allow fluid to flow into lines 45 and 45*a* until a given condition triggers unloading valves 44 to divert the flow of fluid to lines 46 and 49*a* and thence to reservoir 40 via line 47. The condition triggering the diversion of fluid into reservoir 40 is a predetermined pressure being reached downstream of unloading valves 44 (i.e. the pressure in hydraulic cylinders 24** reaching the predetermined value).

When unloading valves 44 are not diverting flow to reservoir 40, hydraulic fluid flows through lines 45 and **45*a*, and thence through line 48 to direction control valve 50. Directional control valve 50 directs the flow of hydraulic fluid to either line 52 or line 54 depending on whether the operator desires the tines 16 to open or close. This direction of fluid by directional control valve 50 may be accomplish by any conventional switching mechanism suitable for the task. However, in a preferred embodiment, directional control valve 50 includes two electrical solenoids. If the operator desires to close tines 16, he may activate directional control valve 50 such that the first solenoid opens a fluid path between lines 48 and 52 and closes a fluid path between lines 49 and 52. This allows fluid to flow into line 52 without being diverted to reservoir 40. From line 52, the fluid flows into the top of cylinders 26 and enters cylinders 26 above piston heads 30, which are attached to rams 28. The fluid then forces rams 28 to extend from cylinder 26, thereby closing fines 16. As the rams 28 are being forced downward, the fluid occupying the cylinder space below the piston head 30 is forced into line 54. Simultaneously, with the above described operation of the first solenoid, the second solenoid opens a fluid path between lines 54 and 49 and closes a fluid path between lines 54 and 48. Thereby, the fluid being displaced from the bottom of cylinders 26 flows through lines 54 and 49 and into reservoir 40 via line 47**.

Similarly, by switching fluid control valve 50 so that the solenoids operate exactly opposite the manner described above, the flow of fluid is reversed. Fluid travels through line 54 to the bottom of cylinders 26 and forces rams 28 to retract into cylinders 26, thereby opening the tines 16. The fluid being forced out of the top part of cylinders 26 by the retracting rams 28 will flow towards directional control valve 50 through line 52. Since directional control valve 50 has now opened a fluid path between lines 52 and 49, the fluid will flow into lines 49 and 47 and finally into reservoir 40. Those skilled in the art will appreciate there could be many alternate embodiments for controlling the flow of hydraulic fluid.

The foregoing disclosure and description of the invention are illustrative thereof and many alternate embodiments will be obvious to those skilled in the art. These and other obvious embodiments are intended to be included within the scope and spirit of the following claims.

I claim:

1. A grapple comprising:

i) a substantially rectangular housing having two sides and an end;

ii) an attachment device positioned on said housing for attaching a tension member to said housing;

iii) a plurality of tines pivotally attached to said housing along each of said sides, wherein each of said plurality of tines has a tine actuating device attached thereto, said actuating devices having a first end attached to said housing and a second end attached to said tines;

iv) at least one tine pivotally attached to said housing along said end, wherein said tine has a tine actuating device attached thereto, said actuating device having a first end attached to said housing and a second end attached to said tine;

v) a fluid supply mechanism operatively attached to said tine actuating devices, said fluid supply mechanism being positioned on said grapple.

2. A grapple according to claim 1, wherein four tines are positioned along each of said side.

3. A grapple according to claim 2, wherein two tines are positioned along said end.

4. A grapple according to claim 1, wherein said tine actuating devices are hydraulic cylinder and ram assemblies.

5. A grapple according to claim 4, wherein said fluid supply mechanism includes a hydraulic pump and a directional control valve.

6. A grapple according to claim 5, wherein said directional control valve includes an electric solenoid.

7. A grapple according to claim 1, wherein said housing includes a central plate attached to a bottom portion of said housing.

8. A grapple according to claim 7, wherein four tines are attached to a first side of said central plate and four tines are attached to a second side of said central plate.

9. A grapple according to claim 1, wherein said end further comprises three segments, a first segment being positioned perpendicular to said side, and a second and third segments being position obliquely to said first segment.

10. A grapple according to claim 9, wherein a tine is positioned beneath and parallel to each of said oblique sections.

* * * * *